United States Patent [19]

Corbin

[11] Patent Number: 4,872,600

[45] Date of Patent: Oct. 10, 1989

[54] SPEED SQUARE INTERLOCKING HOLDER

[76] Inventor: Douglas L. Corbin, P.O. Box 40, Seabrook, S.C. 29940

[21] Appl. No.: 190,253

[22] Filed: May 4, 1988

[51] Int. Cl.[4] ..... A45F 5/00

[52] U.S. Cl. ..... 224/245; 224/251; 224/253; 224/904

[58] Field of Search ..... 224/251, 252, 253, 904, 224/191, 232, 234, 242, 249; 33/484; 248/3091

[56] References Cited

U.S. PATENT DOCUMENTS

| | | | |
|---|---|---|---|
| 2,781,958 | 2/1957 | Lewandowski | 224/251 |
| 4,006,851 | 2/1977 | Kippen | 224/253 |
| 4,223,820 | 9/1980 | Vorsanger et al. | 224/904 |
| 4,253,593 | 3/1981 | Patterman | 224/904 |
| 4,645,104 | 2/1987 | Vokaty | 224/904 |
| 4,662,552 | 5/1987 | Uyehara | 224/251 |

*Primary Examiner*—Henry J. Recla
*Assistant Examiner*—Edward Donovan
*Attorney, Agent, or Firm*—James B. Middleton

[57] ABSTRACT

A holder for a speed square is cylindrically shaped to receive an edge of the square and allow the balance of the square to project out, away from the body. In one form, the slot in the square receives a curved tang, and the square rests on a cam surface so gravity urges the square around and down to a holding slot. A complementary slot prevents loss of the square when a person bends over. In another form of the holder, a straight slot receives the flanged edge of the square. In either case, the tool holder may have a flared base for greater stability when the holder is set on a flat surface.

4 Claims, 1 Drawing Sheet

SPEED SQUARE INTERLOCKING HOLDER

INFORMATION DISCLOSURE STATEMENT

Framing carpenters and the like generally utilize a tool known as a "speed square", the speed square being utilized in laying out rafters for particular roof pitches and the like. The speed square is utilized by almost every framing carpenter, but the square is somewhat awkward in that there is no convenient way to carry the square. The rather natural result is that some carpenters tuck the square into their pants, rendering it easy to lose the square, and also rendering it likely that there will be some pain on bending over and causing the corners of the square to punch the abdomen. The other alternative is to lay the square down between uses, but this especially leads to loss of the square. As a result, many of the speed squares are lost, and a carpenter must replace the square relatively frequently.

While it is known to utilize holsters, various tool holders and the like, it will be understood that the speed square must be readily available for use, but must also be so disposed that it will not cause damage to the person carrying it.

SUMMARY OF THE INVENTION

This invention relates generally to tool holders, and is more particularly concerned with a belt mounted holder for stowing a speed square safely and conveniently.

The present invention provides a tool holder that is conveniently carried on a carpenter's belt, the holder being adapted to receive a speed square. The holder includes a tang receivable in a slot of the speed square, a portion of the speed square being then received in a cam slot so that the weight of the speed square causes further stowing motion of the speed square to a stowed and locked position. When the speed square is to be retrieved, the lock is released simply by raising the speed square, then moving the speed square up the camming surface to release the square from the holder.

The tool holder of the present invention may also have a slightly enlarged base so the tool holder can be set on a flat surface if desired.

In a modified form of the invention, the tool holder includes a straight slot to carry a speed square, the conventional flange of the speed square being received inwardly of the slot and the balance of the square being outwardly of the slot so that the flange prevents removal in one direction, and the holder itself limits motion in the other direction. The sides of the slot restrain the square against lateral motion.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENTS

Figure 1:
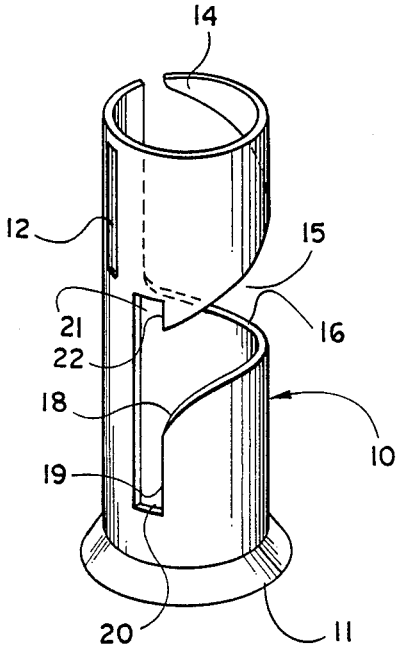
FIG. 1 is a perspective view showing a tool holder made in accordance with the present invention.

Referring now more particularly to the drawings, and those embodiments of the invention here presented by way of illustration, it will be seen in FIG. 1 of the drawings that the tool holder includes a generally cylindrical body designated at 10, the body 10 being shown in FIG. 1 as including an outwardly flared lower end 11. If the diameter of the cylindrical body 10 is sufficiently large for the tool holder to sit stably, the flare 11 may not be necessary; however, for smaller tool holders, the flared base 11 adds stability when the tool holder is sitting on a flat surface.

Figure 3:
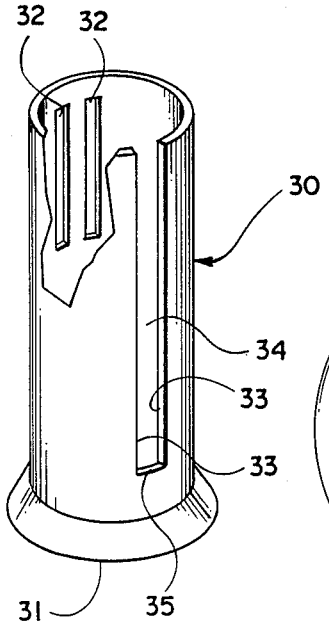
FIG. 3 is a perspective view of a modified form of tool holder.

For carrying the tool holder, there is a slot 12 for receiving a tool belt or the like. The slot 12 will preferably be a double slot as is known in the art. The double slot is shown in FIG. 3 and will be further discussed hereinafter.

At the upper end of the body 10, there is a tang 14 that becomes successively wider around the circumference of the body 10. The tang 14 is defined by a slot 15 in the body 10, the lower edge 16 of the slot 15 being formed as a cam surface.

The cam surface 16 extends to a slightly rounded corner 18 where there is a locking shoulder 19, the shoulder 19 being one side of the slot 20 which is the final resting place of the square in the stowed position.

Since only gravity will hold the square in the slot 20, it will be understood that the square could slip from the tool holder if a person bend over, so some safety means is desired. There is therefore a complementary slot 21 having a locking shoulder 22 aligned with the locking should 19. It will therefore be understood that, if the square moves straight vertically (as the tool holder is shown in FIG. 1) the square will slip into the slot 21 and motion will be prevented by the locking shoulder 22.

Figure 2:
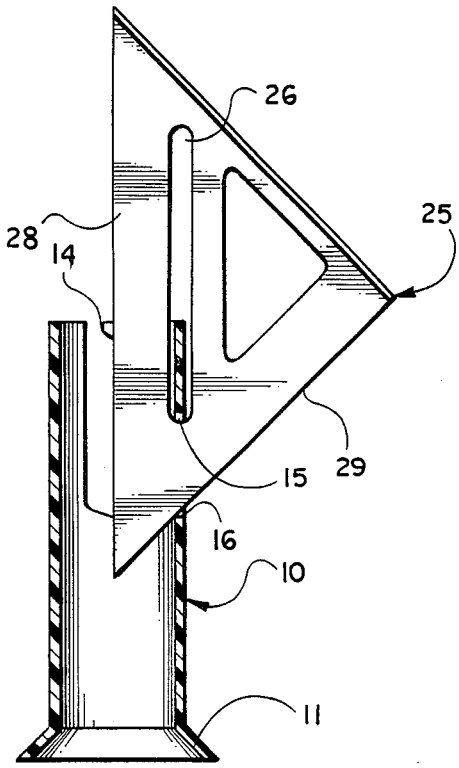
FIG. 2 is a longitudinal cross-sectional view of the tool holder shown in FIG. 1 with a speed square in position on the cam surface.

With the above description in mind, attention is directed to FIG. 2 of the drawings. In FIG. 2 it will be seen that a square is designated at 25 and includes a slot 26. In use of the tool holder, the tang 14 is received within the slot 26; therefore, one will place the hypotenuse of the square 25 into the slot 15 in the tool holder. The diameter of the body 10 must of course be sufficient to receive the width of the square between the hypotenuse 28 and the slot 26. With the hypotenuse portion of the square 25 within the cylindrical body 10, the tang 14 is received through the slot 26. Once the tang 14 is reasonably well through the slot 26, the square 25 can be released. At this point, the lower edge 29 of the square 25 will be resting on the cam surface 16. Since the cam surface 16 is downwardly sloped, gravity will carry the square 25 around the slot 15, and ultimately into the notch 20.

Attention is next direction to FIG. 3 of the drawings which shows a modified form of tool holder. Again, the tool holder of FIG. 3 is formed of a generally cylindrical body designated at 30, the body 30 optionally having a flared base 31 and the double slot 32 to receive a belt or the like. A belt will pass into the body 30 through one slot, then out the other slot. A convenient means for attaching the device to a belt is therefore provided without additional attachments.

The tool holder of FIG. 3 includes a single slot 34 that extends generally parallel to the centerline of the cylindrical body 30.

Figure 4:
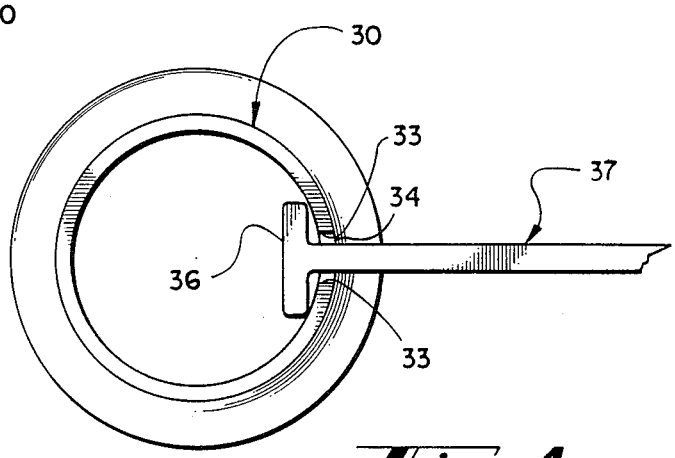
FIG. 4 is an enlarged top plan view of the tool holder shown in FIG. 2, a square being shown received within the tool holder.

The slot 34 is open at the upper end of the tool holder, and terminates at 35, adjacent to the flared base 31. In this embodiment of the invention, it will be seen that the square is again held for reasonable safety in the normal course of business. As is better seen in FIG. 4 of the drawings, the square 37 includes a flange 36 along one of the legs of the right triangle. The width of the flange 36 is greater than the width of the slot 34, but the body of the square 37 is easily receivable within the slot 34. Thus, the square 37 can be simply dropped into the slot 34 with the flange 36 within the confines of the cylindrical body 30. The square will stop at the bottom 35 of the slot 34. The square 37 can move inwardly, but only until the flange 36 contacts the inner wall of the cylindrical body 30, and the square 37 can move outwardly only until the flange 36 contacts the walls adjacent to the slot 34. The square can move laterally only to the edge of the slot, the edges 33 acting as locking shoulders. As a result, the square 37 is reasonably secure within the slot 34.

It will therefore be understood that the present invention provides an extremely simple tool holder that is easily usable for stowing a speed square. When the square is stowed, it is very secure, and is disposed at a person's side so it will not interfere with the usual bending required in carpentry. The tool holder can conveniently be made of conventional plastic materials, but could equally well be made of metal if desired.

It will of course be understood by those skilled in the art that the particular embodiments of the invention here presented are by way of illustration only, and are meant to be in no way restrictive; therefore, numerous changes and modifications may be made, and the full use of equivalents resorted to, without departing from the spirit or scope of the invention as outlined in the appended claims.

I claim:

1. A tool holder, for carrying a tool having an aperture therein on a person's belt or the like, said tool holder comprising a generally cylindrical body having a top and bottom edge, a tool holding slot defined in said cylindrical body for receiving the tool to be held, said tool holding slot extending parallel to the centerline of said cylindrical body and defining a locking shoulder on at least one side of said slot for preventing lateral movement of said tool to be held, and a means for selectively receiving a belt of a user for carrying said tool holder on a person, such that said cylindrical body would be oriented in a generally vertical direction with respect to the user so that said tool holding slot would extends generally, said cylindrical body further defining a cam slot extending from said tool holding slot at an intermediate portion thereof to the top edge of said body, the intersection of said cam slot with said tool holding slot defining said locking shoulder, a tang formed from the wall of said body between said cam slot and top edge and extending circumferentially thereof, the lower edge of said tang comprising the upper edge of to said cam slot, the lower edge of said cam slot comprising a cam surface extending downwardly and circumferentially of said cylindrical body, the arrangement being such that said tang is receivable through said aperture of said tool to be held and said tool rests on said cam surface, said can surface being downwardly sloped such that said tool to be held is movable by gravity along said cam surface towards said tool holding slot.

2. A tool holder as claimed in claim 1, and further including a flared base on said cylindrical body for providing stability for said tool holder.

3. A tool holder as claimed in claim 2, wherein said tool to be held is a speed square having a slot parallel to the hypotenuse of the square, said tang being receivable in said slot in said square, said body having a diameter sufficient to receive said square between said hypotenuse and said slot.

4. A tool holder as claimed in claim 2, and further including a complementary slot aligned with said tool holding slot, said complementary slot being adjacent to said tang for preventing motion of said speed square along said tang when said body is inverted.

* * * * *

UNITED STATES PATENT AND TRADEMARK OFFICE

CERTIFICATE OF CORRECTION

PATENT NO. : 4,872,600

DATED : October 10, 1989

INVENTOR(S) : Douglas L. Corbin

It is certified that error appears in the above-identified patent and that said Letters Patent is hereby corrected as shown below:

Title page item [54], and column 1, line 1,

In the title, delete "SPEED"

Title page item [57],

In the abstract, line 1 delete "speed"

Column 1, line 7 (both occurrences); line 9; line 19; line 22; line 31; line 35; line 36; line 37; line 38; line 39; line 40; line 42 (both occurrences); line 48; line 49; line 65 delete "speed"

Column 3, line 26 delete "speed"

Claim 3, line 2 delete "speed"

Claim 4, line 4 delete "speed"

Signed and Sealed this

Fifteenth Day of August, 2000

*Attest:*

*Attesting Officer*

Q. TODD DICKINSON

*Director of Patents and Trademarks*